US007931757B2

(12) United States Patent
Kondo et al.

(10) Patent No.: US 7,931,757 B2
(45) Date of Patent: Apr. 26, 2011

(54) SEAMLESS STEEL PIPE FOR LINE PIPE AND A PROCESS FOR ITS MANUFACTURE

(75) Inventors: Kunio Kondo, Sanda (JP); Yuji Arai, Amagasaki (JP); Nobuyuki Hisamune, Kinokawa (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 383 days.

(21) Appl. No.: 12/071,492

(22) Filed: Feb. 21, 2008

(65) Prior Publication Data

US 2008/0219878 A1 Sep. 11, 2008

Related U.S. Application Data

(63) Continuation of application No. PCT/JP2006/316395, filed on Aug. 22, 2006.

(30) Foreign Application Priority Data

Aug. 22, 2005 (JP) ..... 2005-240069

(51) Int. Cl.
*C22C 38/04* (2006.01)
*C22C 38/12* (2006.01)
*C21D 8/10* (2006.01)

(52) U.S. Cl. ..... 148/320; 148/333; 148/334; 148/335; 148/336; 148/909; 148/654; 148/593; 148/663

(58) Field of Classification Search ..... 148/320, 148/333–336, 653, 654, 663, 519, 593, 909.52; 420/84, 104–116, 120, 123
See application file for complete search history.

(56) References Cited

FOREIGN PATENT DOCUMENTS

| | | |
|---|---|---|
| JP | 7-331381 | 12/1995 |
| JP | 09-041074 | 2/1997 |
| JP | 9-111343 | 4/1997 |
| JP | 09-235617 | 9/1997 |
| JP | 10-306347 | 11/1998 |
| JP | 11-140580 | 5/1999 |
| JP | 11-172365 | 6/1999 |
| JP | 2000-169913 | 6/2000 |
| JP | 2001-288532 | 10/2001 |
| JP | 2004-124158 | 4/2004 |
| WO | 2004/031420 | 4/2004 |

*Primary Examiner* — Deborah Yee
(74) *Attorney, Agent, or Firm* — Clark & Brody

(57) ABSTRACT

A thick-walled seamless steel pipe for line pipe which has a high strength and improved toughness and corrosion resistance in spite of the thick wall and which is suitable for use as a riser and flow line has a chemical composition comprising, in mass percent, C: 0.02-0.08%, Si: at most 0.5%, Mn: 1.5-3.0%, Al: 0.001-0.10%, Mo: greater than 0.4%-1.2%, N: 0.002-0.015%, at least one of Ca and REM in a total amount of 0.0002-0.007%, and a remainder of Fe and impurities, with the impurities having the content of P: at most 0.05%, S: at most 0.005%, and O: at most 0.005%, the chemical composition satisfying the inequality: $0.8 \leqq [Mn] \times [Mo] \leqq 2.6$, wherein [Mn] and [Mo] are the numbers equivalent to the contents of Mn and Mo, respectively, in mass percent.

7 Claims, 2 Drawing Sheets

SEAMLESS STEEL PIPE FOR LINE PIPE AND A PROCESS FOR ITS MANUFACTURE

This application is a continuation of International Patent Application No. PCT/JP2006/316395, filed Aug. 22, 2006. This PCT application was not in English as published under PCT Article 21(2).

TECHNICAL FIELD

This invention relates to a seamless steel pipe for line pipe having improved strength, toughness, corrosion resistance, and weldability and to a process for manufacturing the same. A seamless steel pipe according to the present invention is a high-strength, high-toughness, thick-walled seamless steel pipe for line pipe having a strength of at least X80 grade prescribed by API (American Petroleum Institute) standards, and specifically a strength of X80 grade (a yield strength of at least 551 MPa), X90 grade (a yield strength of at least 620 MPa), or X100 grade (a yield strength of at least 689 MPa) along with good toughness and corrosion resistance. It is particularly suitable for use as steel pipe for flow lines on the seabed or steel pipe for risers.

BACKGROUND ART

In recent years, since crude oil and natural gas resources in oil fields located on land or in so-called shallow seas having a water depth of up to around 500 meters are being depleted, development of seabed oil fields in so-called deep seas at a depth of 1000-3000 meters, for example, beneath the surface of the sea is being actively carried out. With deep sea oil fields, it is necessary to transfer crude oil or natural gas from the well head of an oil well or natural gas well which is installed on the seabed to a platform on the water surface using steel pipes referred to as flow lines and risers.

Steel pipes constituting flow lines installed deep in the sea or rises are exposed to a high internal fluid pressure applied to their interior due to the formation pressure in deep underground regions and to the effects of water pressure of the deep sea applied to their exterior when operation is stopped. Steel pipes constituting risers are additionally exposed to the effects of repeated strains applied by waves.

Flow lines are steel pipes for transport which are installed on the ground or along the contours of the seabed. Risers are steel pipes for the transportation of oil or gas which rise from the surface of the seabed to a platform on the surface of the sea. When such pipes are used in a deep sea oil fields, it is considered necessary for the wall thickness to usually be at least 30 mm, and actually thick-walled steel pipes having a wall thickness in the range of 40 mm to 50 mm are generally used. This indicates that they are used under very severe conditions.

FIG. 1 is an explanatory view schematically showing an example of an arrangement of risers and flow lines in the sea. In the figure, a well head 12 provided on the seabed 10 and a platform 14 provided on the water surface 13 immediately above it are connected by a top tension riser 16. A flow line 18 installed on the seabed and connected to an unillustrated remote well head extends to the vicinity of the platform 14.

The end of the flow line 18 is connected to the platform 14 by a steel catenary riser 20 which rises from the vicinity of the platform.

The environment of use of the risers and the flow lines is very severe, and it is said that the maximum temperature is 177° C. and the maximum internal pressure is 1400 atmospheres or more. Therefore, the steel pipes used in the risers and flow lines must be able to withstand such a severe environment. A riser is also subjected to bending stress due to waves, so it must be able to also withstand such external influences.

Accordingly, a steel pipe having a high strength and high toughness is desired for use as risers and flow lines. In order to ensure reliability, seamless steel pipes rather than welded steel pipes are used in such applications.

For welded steel pipes, a technique for manufacturing a steel pipe having a strength exceeding X80 grade has already been disclosed. For example, Patent Document 1 (JP H9-41074A) discloses a steel which exceeds X100 grade (a yield strength of at least 689 MPa) set forth in API standards. A welded steel pipe is manufactured by first producing a steel plate, rolling up the steel plate, and welding the seam to form a steel pipe. In order to impart essential properties such as strength and toughness at the time of producing the steel plate, control of the microstructure has been employed by subjecting the steel sheet to thermomechanical treatment at the stage of rolling. Also in Patent Document 1, the desired properties of a steel pipe after welding are secured by performing thermomechanical treatment during hot rolling of a steel sheet in such a manner that the microstructure is controlled so as to include deformed ferrite. Accordingly, the technique disclosed in Patent Document 1 can be realized just by a rolling process to form a steel plate in which thermomechanical treatment can be easily applied by controlled rolling, and therefore it can be applied to a welded steel pipe but not to a seamless steel pipe.

In the case of seamless steel pipes, a seamless steel pipe of X80 grade has been developed recently. With seamless steel pipes, since application of the above-described technique including thermomechanical treatment which has been developed for welded steel pipes is difficult, it is basically necessary to attain the desired properties by heat treatment after pipe formation. For example, a technique for manufacturing a seamless steel pipe of X80 grade (a yield strength of at least 551 MPa) is disclosed in Patent Document 2 (JP 2001-288532A). However, as disclosed in the examples of that document, the technique is merely demonstrated for a thin-walled steel pipe (with a wall thickness of 11.0 mm) for which hardenability is inherently good. Accordingly, even if the technique disclosed therein is employed, when a seamless steel pipe with a wall thickness of around 40-50 mm which is actually used for risers or flow lines, there is a problem in that an adequate strength and toughness cannot be attained since the cooling speed at the time of hardening is slow particularly in the central portion of such a thick-walled steel pipe.

DISCLOSURE OF THE INVENTION

The present invention aims to solve the above-described problem. Specifically, its object is to provide a seamless steel pipe for line pipe having a high strength and stable toughness and good corrosion resistance particularly in the case of a thick-walled seamless steel pipe as well as a process for its manufacture.

With respect to a conventional steel for line pipes, it is known that the strength of steel can be predicted by the formula for C equivalent shown below by the formula for CE (IIW) and the formula for Pcm. Based on these formulae, the strength of the steel has been adjusted and material design has been carried out.

$$CE(IIW)=C+Mn/6+(Cr+Mo+V)/5+(Ni+Cu)/15$$

$$Pcm=C+Si/30+(Mn+Cu+Cr)/20+Ni/60+Mo/15+V/10+5B$$

Although these formulae apply to a conventional steel for line pipe, in the case of a material for thick-walled steel pipes having a wall thickness exceeding 30 mm intended for use as risers or flow lines, for which a still higher strength has been demanded recently, the above formulae are not reliable, and it was found that even a steel material which is expected to have a high strength based on the above formulae may sometimes possess a markedly decreased property in toughness particularly. Thus, it is insufficient merely to add the alloying elements set forth in the formulae for C equivalent in order to provide a steel with high strength, and it is also necessary to improve its toughness.

The present inventors analyzed the factors controlling the toughness of a thick-walled seamless steel pipe. As a result, they found that in order to provide high strength and improved toughness particularly with a large wall thickness, it is important to suppress the C content to a low level and add Ca or REM as an essential alloying element, with the product of the added amount of Mn multiplied by the added amount of Mo in mass percent being at least 0.8. Furthermore, if necessary, one or more of Cr, Ti, Ni, Nb, V, Cu, B, and Mg can be added, and in such cases, it is also important to control their contents within prescribed ranges.

The mechanism whereby a high strength and improvements in toughness are realized in the present invention is not clear, but it is thought to be as follows, although the present invention is not bound by the mechanism.

Mn is effective at increasing hardenability of steel and serves to increase strength and toughness by facilitating the formation of a fine transformed structure up to the center of a thick-walled member. On the other hand, addition of Mo, which is effective at increasing the resistance of steel to temper softening, makes it possible to set a higher temperature for tempering to achieve the same target strength, thereby contributing to a great increase in toughness. The above-described effect of Mn or Mo can be obtained even when either of these elements is added solely, but when these elements are added together at least at a certain level, due to a synergistic effect of an increase in hardenability and capability of tempering at a higher temperature, it becomes possible to provide a thick-walled seamless steel pipe with a high strength and high toughness of a level which could not be achieved in the past. When the content of Mn is higher than one in a conventional range, MnS which decreases toughness and corrosion resistance tends to easily precipitate. In this respect, further improvement in toughness and corrosion resistance can be achieved by adding Ca or REM in order to prevent the precipitation of MnS and by decreasing the C content so as to decrease the amount of precipitated carbides.

In the case of a steel material having the above-described chemical composition, a manufacturing process including quenching and tempering after pipe formation is suitable in order to obtain a thick-walled seamless steel pipe having high strength and toughness.

A seamless steel pipe for line pipe according to the present invention is characterized by having a chemical composition containing, in mass percent, C: 0.02-0.08%, Si: at most 0.5%, Mn: 1.5-3.0%, Al: 0.001-0.10%, Mo: greater than 0.4%-1.2%, N: 0.002-0.015%, at least one of Ca and REM in a total of 0.0002-0.007%, and a remainder of Fe and impurities, the impurities having the content of P: at most 0.05%, S: at most 0.005%, and O: at most 0.005%, and the chemical composition satisfying the following inequality:

$$0.8 \leqq [Mn] \times [Mo] \leqq 2.6,$$

wherein [Mn] and [Mo] are the numbers equivalent to the contents of Mn and Mo, respectively, in mass percent.

The chemical composition may further contain one or more elements, in mass percent, selected from Cr: at most 1.0%, Ti: at most 0.05%, Ni: at most 2.0%, Nb: at most 0.04%, V: at most 0.2%, Cu: at most 1.5%, B: at most 0.01%, and Mg: at most 0.007%.

The present invention also relates to a process for a seamless steel pipe for line pipe.

In one embodiment, the process according to the present invention comprises forming a seamless steel pipe by hot working from a steel billet having the above-described chemical composition, then cooling and subsequent reheating the steel pipe, and performing quenching and subsequent tempering on the steel pipe.

In another embodiment, the process according to the present invention comprises forming a seamless steel pipe by hot working from a steel billet having the above-described chemical composition, and immediately performing quenching and subsequent tempering on the steel pipe.

According to the present invention, by prescribing the chemical composition, i.e., the steel composition of a seamless steel pipe and a process for its manufacture as set forth above, particularly in the case of a thick-walled seamless steel pipe having a thickness of at least 30 mm, it is possible to manufacture a seamless steel pipe for line pipe having a high strength of X80 grade (a yield strength of at least 551 MPa), X90 grade (a yield strength of at least 620 MPa), or X100 grade (a yield strength of at least 689 MPa) and having improved toughness and corrosion resistance just by heat treatment in the form of quenching and tempering.

The terms "line pipe" used herein refers to a tubular structure which is intended for use in transportation of fluids such as crude oil or natural gas, not only on land, but also on the sea and in the sea. A seamless steel pipe according to the present invention is particularly suitable for use as line pipe such as the above-described flow line or riser which is located on the sea or in the sea. However its end use is not limited thereto.

There are no particular limits on shape or dimensions of a seamless steel pipe according to the present invention, but there are restrictions on the size of a seamless steel pipe due to its manufacturing process. Usually, it has an outer diameter which is a maximum of around 500 mm and a minimum of around 150 mm. The effects of the present invention are particularly marked when the wall thickness is at least 30 mm, but the present invention is not limited to this wall thickness.

A seamless steel pipe according to the present invention can be used for installation in more severe deep seas and particularly as flow lines on the seabed. Accordingly, the present invention greatly contributes to stable supply of energy. When it is used as a riser or a flow line installed in deep seas, it preferably has a wall thickness of at least 30 mm. The upper limit of the wall thickness is not limited, but normally the wall thickness will be at most 60 mm.

BEST MODE FOR CARRYING OUT THE INVENTION

Figure 1:
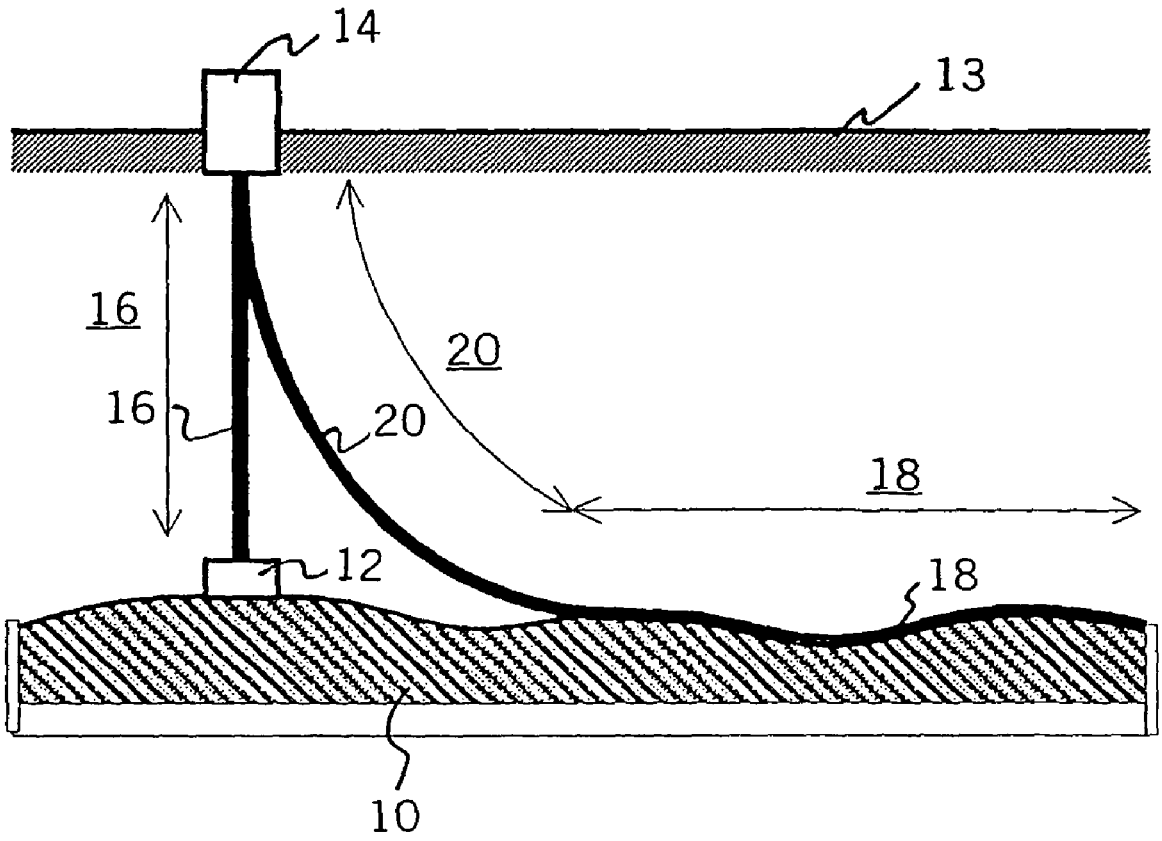
FIG. 1 is an explanatory schematic view showing one end use of a seamless steel pipe according to the present invention.

The reasons why the chemical composition of a steel pipe is prescribed in the above manner in the present invention will be described. As set forth above, percent with respect to the content (concentration) of an element in a chemical composition means mass percent.

C: 0.02-0.08%

C is an important element for obtaining the strength of steel. The C content is at least 0.02% in order to increase hardenability and obtain a sufficient strength of a thick-walled material. On the other hand, if its content exceeds 0.08%, toughness decreases. Therefore, the C content is in the range of 0.02-0.08%. From the standpoint of obtaining the strength of a thick-walled material, a preferred lower limit of the C content is 0.03% and a more preferred lower limit is 0.04%. A more preferred upper limit of the C content is 0.06%.

Si: at most 0.5%

Si acts as a deoxidizing agent during steelmaking, and although its addition is necessary, its content is preferably as small as possible. This is because it greatly decreases toughness, particularly in heat affected zones during circumferential welding to connect line pipes. If the Si content exceeds 0.5%, the toughness is markedly decreased in heat affected zones during large heat input welding. Therefore, the content of Si which is added as a deoxidizing agent is limited to at most 0.5%. Preferably the Si content is at most 0.3% and more preferably at most 0.15%.

Mn: 1.5-3.0%

Mn must be added in a large amount in order to increase the hardenability of steel so that even a thick material can be strengthened up to its center and at the same time in order to improved the toughness thereof. These effects cannot be obtained if its content is less than 1.5%, while if its content exceeds 3%, resistance to HIC (hydrogen induced cracking) decreases. Therefore, the Mn content is in the range of 1.5-3.0%. The lower limit of the Mn content is preferably 1.8%, more preferably 2.0%, and still more preferably 2.1%. As stated below, since addition of Mn together with Mo provides a synergistic effect at obtaining high strength and high toughness, the amount of Mn should be decided taking the added amount of Mo into account.

Al: 0.001-0.10%

Al is added as a deoxidizing agent during steelmaking. In order to obtain this effect, it is added with a content of at least 0.001%. If the Al content exceeds 0.10%, inclusions in the steel form clusters, thereby causing toughness to deteriorate, and a large number of surface defects form at the time of beveling of the ends of a pipe. Therefore, the Al content is 0.001-0.10%. From the standpoint of preventing surface defects, it is preferable to further restrict the upper limit of the Al content. A preferred upper limit is 0.05%, and a more preferred upper limit is 0.03%. In order to fully effect deoxidation and increase toughness, a preferred lower limit on the Al content is 0.010%. The Al content used herein indicates the content of acid soluble Al (so-called "sol. Al").

Mo: greater than 0.4%-1.2%

Mo is an important element in the present invention in that it has an effect of increasing the hardenability of steel particularly even under conditions having a slow cooling speed, thereby making it possible to strengthen up to the center of even a thick material, and at the same time increasing the resistance of the steel to temper softening, thereby making it possible to perform tempering at a higher temperature so as to improve toughness. In order to obtain these effects, it is necessary for the content of Mo to be greater than 0.4%. A more preferred lower limit of the Mo content is 0.5%, and a still more preferred lower limit is 0.6%. However, Mo is an expensive element, and its effects saturate at around 1.2%, so the upper limit is made 1.2%. As stated below, Mo provides a high strength and high toughness by a synergistic effect when added with Mn, and the amount of Mo should be decided taking the added amount of Mn into consideration.

N: 0.002-0.015%

The content of N is made at least 0.002% in order to increase the hardenability of steel so that sufficient strength can be obtained in a thick material. On the other hand, if the N content exceeds 0.015%, toughness decreases. Therefore, the N content is in the range of 0.002-0.015%.

At least one of Ca and REM: 0.0002-0.007% in total

These elements are added in order to improve toughness and corrosion resistance of steel by shape control of inclusions and in order to improve casting properties by suppressing clogging of a nozzle at the time of casting. In order to obtain these effects, at least one of Ca and REM is added in a total amount of at least 0.0002%. If the total amount of these elements exceeds 0.007%, the above-described effects saturate, and not only is a further effect not exhibited, but it becomes easy for inclusions to form clusters, thereby causing toughness and resistance to HIC to decrease. Accordingly, these elements are added such that the total content of one or more of these is in the range of 0.0002-0.007% and preferably 0.0002-0.005%. REM is a generic name for the 17 elements including the elements in the lanthanoid series, Y, and Sc. In the present invention, the content of REM refers to the total amount of at least one of these elements.

A seamless steel pipe for line pipe according to the present invention contains the above-described elements, and a remainder of Fe and impurities. Among the impurities, an upper limit is set on the content of each of P, S, and O as follows.

P: at most 0.05%

P is an impurity element which decreases toughness of steel, so its content is preferably made as low as possible. If its content exceeds 0.05%, the steel has a markedly decreased toughness, so the allowable upper limit of P is made 0.05%. Preferably the P content is at most 0.02% and more preferably at most 0.01%.

S: at most 0.005%

S is also an impurity element which decreases toughness of steel, so its content is preferably made as small as possible. If its content exceeds 0.005%, the steel has a markedly decreased toughness, so the allowable upper limit of S is made 0.005%. Preferably it is made at most 0.003% and more preferably at most 0.001%.

O: at most 0.005%

O is also an impurity element which decreases toughness of steel, so its content is preferably made as low as possible. If its content exceeds 0.005%, toughness markedly decreases, so the allowable upper limit of O is made 0.005%. Its content is preferably at most 0.003% and more preferably at most 0.002%.

In addition to the limitations on each of the above-described elements, the Mn and Mo contents of a seamless steel pipe for line pipe according to the present invention are adjusted so as to satisfy the following formula:

$$0.8 \leqq [Mn] \times [Mo] \leqq 2.6$$

wherein [Mn] and [Mo] are the numbers equivalent to the contents of Mn and Mo expressed in mass percent.

By having Mn and Mo contents which are within the respective ranges prescribed above and which satisfy the above formula, a seamless steel pipe having a high strength and high toughness as aimed by the present invention can be obtained. In general, a steel having a larger value for [Mn]×[Mo] has a higher strength and toughness. Preferably the value is at least 0.9, more preferably at least 1.0, and still more preferably at least 1.1. If the value of [Mn]×[Mo] exceeds 2.6, toughness starts to decrease, so the upper limit thereof is made 2.6.

A seamless steel for line pipe according to the present invention can achieve a yet higher strength, higher toughness, and/or higher corrosion resistance by adding one or more of the following elements as necessary to the chemical composition prescribed in the above manner.

Cr: at most 1.0%

Cr need not be added, but it may be added in order to increase the hardenability of steel, thereby increasing the strength of a thick-walled steel member. However, if its content becomes excessive, it ends up decreasing toughness. Thus, when Cr is added, its content is at most 1.0%. There is no particular lower limit of Cr, but its effects become particularly marked when its content is at least 0.02%. A preferred lower limit on the Cr content when it is added is 0.1% and a more preferred limit is 0.2%.

Ti: at most 0.05%

Ti need not be added, but it can be added in order to achieve its effects of preventing surface defects at the time of continuous casting and providing a high strength with refining crystal grains. If the Ti content exceeds 0.05%, toughness decreases, so its upper limit is 0.05%. There is no particular lower limit on the Ti content, but in order to obtain its effects, it is preferably at least 0.003%.

Ni: at most 2.0%

Ni need not be added, but it can be added in order to increase the hardenability of steel, thereby increasing the strength of a thick-walled steel member, and also in order to increase the toughness of steel. However, Ni is an expensive element, and if too much is contained, its effects saturate, so when it is added, its upper limit is 2.0%. There is no particular lower limit on the Ni content, but its effects are particularly marked when its content is at least 0.02%.

Nb: at most 0.04%

Nb need not be added, but it can be added in order to obtain the effects of increasing strength and refining crystal grains. If the Nb content exceeds 0.04%, toughness decreases, so when it is added, its upper limit is 0.04%. There is no particular lower limit on the Nb content, but in order to obtain the above effects, its content is preferably at least 0.003%.

V: at most 0.2%

Addition of V is determined by the balance between strength and toughness. When a sufficient strength is obtained by other alloying elements, a good toughness is obtained by not adding V. When V is added as a strength increasing element, its content is preferably at least 0.003%. If its content exceeds 0.2%, toughness greatly decreases, so when it is added, the upper limit on the V content is 0.2%.

Cu: at most 1.5%

Cu need not be added, but it may be added in order to improve the resistance to HIC. The minimum Cu content for exhibiting an improvement in HIC resistance is 0.02%. Its effect saturates when the Cu content exceeds 1.5%, so when it is added, the Cu content is preferably 0.02-1.5%.

B: at most 0.01%

B need not be added, but it improves the hardenability of steel when added even in a minute amount, so it is effective to add B when a higher strength is necessary. In order to obtain this effect, it is desirable to add at least 0.0002% of B. However, excessive addition thereof decreases toughness, so when B is added, its content is at most 0.01%.

Mg: at most 0.007%

Mg need not be added, but it increases toughness when added even in a minute amount, so it is effective to add Mg, particularly when it is desired to obtain toughness in a weld zone. In order to obtain these effects, it is desirable for the Mg content to be at least 0.0002%. However, excessive addition ends up decreasing toughness, so when Mg is added, its content is at most 0.007%.

Next, a process of manufacturing a seamless steel pipe according to the present invention will be explained. In this invention, there are no particular limitations on the manufacturing process itself, and a usual process for the manufacture of a seamless steel pipe can be employed. According to the present invention, a high strength, high toughness, and good corrosion resistance are achieved by subjecting a steel pipe having a wall thickness of at least 30 mm to quenching and then tempering. Below, preferred manufacturing conditions for a manufacturing process according to the present invention will be described.

Seamless Steel Pipe Formation:

Molten steel prepared so as to have a chemical composition as described above is, for example, cast by continuous casting to form a cast mass having a round cross section, which is directly used as material for rolling (billet), or to form a cast mass having a rectangular cross section, which is then formed by rolling into a billet having a round cross section. The resulting billet is subjected to piercing, rolling, and sizing under hot working conditions to form a seamless steel pipe.

The working conditions to form the pipe may be the same as conventionally employed in the manufacture of a seamless steel pipe by hot working, and there are no particular limitations thereon in the present invention. However, in order to achieve shape control of inclusions so as to secure the hardenability of the steel at the time of subsequent heat treatment, it is preferable that hot working for pipe formation be performed with a heating temperature for hot piercing of at least 1150° C. and a finish rolling temperature of at most 1100° C.

Heat Treatment after Pipe Formation:

The seamless steel pipe produced by pipe formation is subjected to quenching and tempering for heat treatment. Quenching may be carried out either by a process in which once the formed hot steel pipe is cooled, it is reheated and then quenched for hardening, or a process in which quenching for hardening is carried out immediately after pipe formation, without reheating, in order to exploit the heat of the formed hot steel pipe.

When the steel pipe is cooled before quenching, the finishing temperature of cooling is not limited. For example, the pipe may be let cool to room temperature before it is reheated for quenching, or it may be cooled to around 500° C., at which transformation occurs, before it is reheated for quenching, or it may be cooled during transport to a reheating furnace, where it is immediately heated for quenching. The reheating temperature is preferably 880-1000° C.

Quenching is followed by tempering, which is preferably carried out at a temperature of 550-700° C. In the present invention, the steel has a chemical composition containing a relatively large amount of Mo, which provides the steel with a high resistance to temper softening and makes it possible to perform tempering at a higher temperature so as to improve toughness. In order to exploit this effect, it is preferred that tempering be carried out at a temperature of 600° C. or above. The temperature for tempering is preferably 600-650° C.

In this manner, according to the present invention, a seamless steel pipe for line pipe having a high strength of at least X80 grade and improved toughness and corrosion resistance even with a large wall thickness can stably be manufactured. The seamless steel pipe can be used as line pipe in deep seas, namely as a riser or flow line, so the present invention has great practical significance.

The following example is intended to demonstrate the effects of the present invention and not intended to restrict the invention in any way.

EXAMPLE

As materials for rolling, billets having a round cross section and the steel compositions shown in Table 1 were prepared by a conventional process including melting, casting, and rough rolling. On the resulting billets, hot pipe-forming working including piercing, rolling (drawing), and sizing was performed using Mannesmann mandrel mill-type pipe forming equipment to produce seamless steel pipes having an outer diameter of 219.1 mm and a wall thickness of 40 mm. For each pipe, the heating temperature for piercing was in the range of from 1150° C. to 1270° C., and the finish rolling temperature in sizing was as shown in Table 2.

The resulting steel pipes were subjected to quenching and tempering under the conditions shown in Table 2. In Table 2, those steels for which the values of finish cooling temperature (finishing temperature of cooling) and reheating temperature are indicated means that after hot rolling, the steel pipes were cooled and then reheated for quenching. On the other hand, those steels for which the values of finish cooling temperature and reheating temperature are not indicated means that the steel pipes were quenched immediately after hot rolling. Quenching was carried out by water cooling. Tempering was carried out by placing the steel pipes in a heating furnace in which each steel pipe was isothermally treated for 15 minutes at the indicated temperature.

Each of the resulting steel pipes was tested with respect to strength, toughness, and corrosion resistance in the following manner. The test results are also shown in Table 2.

Strength was evaluated by the yield strength (YS) measured in a tensile test, which was carried out in accordance with JIS Z 2241 using a JIS No. 12 tensile test piece taken from the steel pipe to be tested.

Toughness was evaluated by the fracture appearance transition temperature (FATT) determined in a Charpy impact test. The test was carried out using an impact test piece which measured 10 mm (width)×10 mm (thickness) with a 2-mm V-shaped notch and was taken from the center of the wall thickness in the longitudinal direction of the steel pipe in accordance with No. 4 test piece in JIS Z 2202. The lower this transition temperature, the better the toughness.

Corrosion resistance was evaluated by resistance to sulfide stress cracking (SSC) determined by a test using as a test solution an aqueous 5% NaCl solution which was saturated with $H_2S$ at atmospheric pressure and to which 0.5% $CH_3COOH$ was added [a so-called NACE (National Association of Corrosion Engineers) solution, temperature=25° C., pH=2.7-4.0]. Three rectangular 4-point bending test pieces which measured a thickness of 2 mm, a width of 10 mm, and a length of 100 mm and which were each taken from the center of the wall thickness of each steel pipe in the longitudinal direction were immersed in the test solution for 720 hours while a stress equivalent to 90% of the yield stress of the pipe was applied to each test piece, and resistance to SSC was evaluated based on whether there was any crack found after the immersion.

In Table 2, the results of the evaluation are indicated by an X when there was a crack observed and by a circle (○) when there was no crack. The case in which the three test pieces were all without a crack is indicated by "○○○", and the case in which the three test pieces all had a crack is indicated by "XXX".

TABLE 1

| Steel No. | Chemical composition of steel (mass %, bal.: Fe and impurities; among the elements indicated below, P, S, and O are impirities) | | | | | | | | | | | | | | | | | | | | |
|---|---|---|---|---|---|---|---|---|---|---|---|---|---|---|---|---|---|---|---|---|---|
| | C | Si | Mn | sol. Al | P | S | Mo | N | Ca | REM | O | Cr | Ti | Ni | Nb | V | Cu | B | Mg | [Mn] × [Mo] | Remark |
| 1 | 0.06 | 0.28 | 2.16 | 0.021 | 0.008 | 0.0006 | 0.64 | 0.0031 | 0.0023 | — | 0.0023 | 0.20 | 0.0081 | — | 0.011 | 0.05 | 0.30 | 0.0014 | 0.0038 | 1.38 | Invent. |
| 2 | 0.05 | 0.17 | 1.95 | 0.027 | 0.006 | 0.0013 | 0.55 | 0.0045 | 0.0015 | — | 0.0021 | 0.15 | — | — | — | 0.12 | 0.30 | — | — | 1.07 | Invent. |
| 3 | 0.03 | 0.25 | 2.01 | 0.025 | 0.004 | 0.0006 | 0.80 | 0.0034 | 0.0017 | — | 0.0017 | 0.49 | — | — | 0.015 | — | 0.32 | — | 0.0027 | 1.61 | Invent. |
| 4 | 0.05 | 0.35 | 2.82 | 0.021 | 0.005 | 0.0012 | 0.55 | 0.0032 | 0.0012 | — | 0.0017 | 0.43 | 0.0060 | — | — | — | 0.12 | — | 0.0012 | 1.55 | Invent. |
| 5 | 0.03 | 0.17 | 2.66 | 0.022 | 0.008 | 0.0012 | 0.46 | 0.0039 | 0.0025 | — | 0.0028 | 0.22 | — | — | 0.018 | 0.11 | 0.25 | 0.0014 | — | 1.22 | Invent. |
| 6 | 0.05 | 0.12 | 2.46 | 0.028 | 0.005 | 0.0010 | 0.66 | 0.0041 | 0.0022 | — | 0.0027 | 0.23 | 0.0139 | 0.19 | — | 0.11 | 0.30 | 0.0015 | 0.0021 | 1.62 | Invent. |
| 7 | 0.06 | 0.17 | 1.86 | 0.019 | 0.006 | 0.0009 | 0.71 | 0.0059 | 0.0018 | — | 0.0011 | 0.49 | 0.0073 | — | — | 0.07 | — | 0.0007 | 0.0010 | 1.32 | Invent. |
| 8 | 0.04 | 0.40 | 2.48 | 0.027 | 0.014 | 0.0013 | 0.47 | 0.0057 | 0.0011 | — | 0.0018 | 0.11 | 0.0086 | 0.29 | — | — | 0.27 | — | — | 1.17 | Invent. |
| 9 | 0.07 | 0.23 | 2.73 | 0.017 | 0.008 | 0.0006 | 0.44 | 0.0034 | 0.0012 | — | 0.0024 | — | — | — | — | — | — | — | — | 1.20 | Invent. |
| 10 | 0.06 | 0.10 | 2.52 | 0.025 | 0.015 | 0.0009 | 0.50 | 0.0057 | 0.0024 | — | 0.0027 | 0.22 | 0.0147 | — | 0.013 | 0.07 | — | 0.0016 | 0.0031 | 1.26 | Invent. |
| 11 | 0.04 | 0.25 | 2.94 | 0.026 | 0.008 | 0.0013 | 0.61 | 0.0059 | 0.0017 | — | 0.0025 | 0.49 | — | — | 0.013 | 0.10 | — | 0.0017 | 0.0022 | 1.79 | Invent. |
| 12 | 0.06 | 0.26 | 2.06 | 0.023 | 0.017 | 0.0009 | 0.65 | 0.0043 | 0.0015 | — | 0.0019 | 0.21 | — | — | 0.022 | 0.08 | — | — | 0.0013 | 1.34 | Invent. |
| 13 | 0.04 | 0.31 | 1.77 | 0.024 | 0.018 | 0.0014 | 0.67 | 0.0040 | 0.0018 | — | 0.0017 | 0.39 | — | — | 0.009 | 0.09 | — | — | — | 1.19 | Invent. |
| 14 | 0.05 | 0.18 | 2.67 | 0.029 | 0.019 | 0.0010 | 0.75 | 0.0057 | 0.0009 | — | 0.0011 | 0.11 | 0.0125 | 0.30 | — | 0.08 | 0.31 | — | 0.0016 | 2.00 | Invent. |
| 15 | 0.07 | 0.33 | 2.59 | 0.027 | 0.006 | 0.0013 | 0.62 | 0.0050 | 0.0022 | — | 0.0028 | 0.18 | 0.0112 | 0.21 | 0.022 | — | 0.21 | 0.0009 | — | 1.61 | Invent. |
| 16 | 0.05 | 0.18 | 2.58 | 0.015 | 0.016 | 0.0013 | 0.67 | 0.0038 | 0.0026 | — | 0.0023 | 0.43 | 0.0117 | 0.28 | — | — | 0.38 | — | 0.0015 | 1.73 | Invent. |
| 17 | 0.07 | 0.29 | 1.83 | 0.022 | 0.018 | 0.0016 | 0.64 | 0.0049 | 0.0025 | — | 0.0024 | 0.33 | 0.0089 | — | 0.012 | — | — | — | — | 1.17 | Invent. |
| 18 | 0.07 | 0.29 | 2.63 | 0.026 | 0.017 | 0.0008 | 0.57 | 0.0057 | 0.0017 | — | 0.0030 | 0.35 | 0.0097 | 0.15 | — | — | — | — | — | 1.50 | Invent. |
| 19 | 0.05 | 0.34 | 2.12 | 0.020 | 0.006 | 0.0013 | 0.61 | 0.0044 | 0.0018 | — | 0.0013 | 0.48 | — | — | — | 0.12 | — | — | 0.0011 | 1.29 | Invent. |
| 20 | 0.07 | 0.21 | 1.71 | 0.021 | 0.005 | 0.0007 | 0.64 | 0.0059 | 0.0016 | — | 0.0013 | 0.40 | 0.0142 | — | 0.018 | — | 0.25 | — | 0.0019 | 1.09 | Invent. |
| 21 | 0.06 | 0.14 | 2.86 | 0.016 | 0.012 | 0.0008 | 0.74 | 0.0057 | 0.0027 | — | 0.0027 | 0.27 | 0.0091 | — | — | 0.10 | — | — | — | 2.12 | Invent. |
| 22 | 0.05 | 0.16 | 2.06 | 0.020 | 0.007 | 0.0013 | 0.70 | 0.0036 | 0.0008 | — | 0.0026 | 0.12 | 0.0098 | — | 0.009 | — | — | — | 0.0034 | 1.44 | Invent. |
| 23 | 0.07 | 0.24 | 2.48 | 0.017 | 0.006 | 0.0005 | 0.50 | 0.0033 | 0.0017 | — | 0.0021 | 0.23 | 0.0079 | — | — | 0.09 | 0.37 | — | — | 1.24 | Invent. |
| 24 | 0.04 | 0.21 | 2.25 | 0.018 | 0.007 | 0.0010 | 0.41 | 0.0055 | 0.0027 | — | 0.0028 | 0.26 | 0.0070 | — | — | — | — | 0.0008 | 0.0038 | 0.92 | Invent. |
| 25 | 0.04 | 0.11 | 1.96 | 0.028 | 0.010 | 0.0006 | 0.53 | 0.0051 | 0.0011 | — | 0.0021 | 0.38 | 0.0093 | — | — | 0.07 | — | — | 0.0037 | 1.04 | Invent. |
| 26 | 0.06 | 0.37 | 2.21 | 0.018 | 0.018 | 0.0006 | 0.60 | 0.0049 | 0.0023 | 0.0007 | 0.0021 | 0.31 | 0.0139 | 0.13 | — | 0.10 | 0.17 | — | — | 1.33 | Invent. |
| 27 | 0.04 | 0.27 | 1.65 | 0.017 | 0.008 | 0.0008 | 0.54 | 0.0049 | 0.0027 | — | 0.0027 | 0.27 | 0.0064 | 0.13 | 0.009 | 0.11 | 0.14 | 0.0015 | — | 0.89 | Invent. |
| 28 | 0.06 | 0.29 | 2.08 | 0.021 | 0.017 | 0.0011 | 0.57 | 0.0057 | 0.0015 | — | 0.0016 | 0.13 | — | — | 0.015 | 0.06 | — | 0.0012 | — | 1.19 | Invent. |
| 29 | 0.06 | 0.19 | 1.96 | 0.017 | 0.004 | 0.0010 | 0.53 | 0.0039 | 0.0026 | — | 0.0012 | — | — | — | — | — | — | — | — | 1.04 | Invent. |
| 30 | 0.05 | 0.40 | 2.30 | 0.021 | 0.006 | 0.0013 | 0.44 | 0.0058 | 0.0015 | — | 0.0023 | 0.38 | 0.0146 | 0.26 | 0.009 | — | — | 0.0019 | 0.0035 | 1.01 | Invent. |
| 31 | 0.06 | 0.13 | 2.88 | 0.024 | 0.008 | 0.0016 | 0.48 | 0.0045 | 0.0013 | — | 0.0011 | 0.42 | — | — | 0.007 | — | — | — | 0.0035 | 1.38 | Invent. |
| 32 | 0.04 | 0.29 | 2.66 | 0.020 | 0.010 | 0.0015 | 0.60 | 0.0044 | 0.0021 | — | 0.0011 | 0.48 | 0.0073 | — | 0.019 | — | — | 0.0008 | — | 1.60 | Invent. |
| 33 | 0.04 | 0.12 | 2.98 | 0.015 | 0.013 | 0.0007 | 0.50 | 0.0031 | 0.0009 | — | 0.0019 | 0.12 | 0.0145 | — | 0.017 | — | 0.32 | — | — | 1.49 | Invent. |
| 34 | 0.06 | 0.11 | 2.83 | 0.026 | 0.017 | 0.0011 | 0.56 | 0.0057 | 0.0014 | — | 0.0010 | 0.33 | — | — | — | 0.07 | — | 0.0013 | 0.0036 | 1.58 | Invent. |
| 35 | 0.06 | 0.27 | 2.17 | 0.027 | 0.010 | 0.0013 | 0.58 | 0.0036 | 0.0018 | — | 0.0012 | 0.21 | 0.0125 | — | — | 0.11 | 0.21 | 0.0018 | — | 1.26 | Invent. |
| 36 | 0.07 | 0.12 | 2.10 | 0.021 | 0.013 | 0.0004 | 0.70 | 0.0048 | 0.0026 | — | 0.0024 | 0.48 | 0.0091 | 0.36 | 0.017 | — | 0.25 | — | 0.0035 | 1.47 | Invent. |
| 37 | 0.06 | 0.15 | 1.67 | 0.024 | 0.015 | 0.0009 | 0.59 | 0.0047 | 0.0008 | — | 0.0020 | 0.49 | 0.0101 | 0.13 | — | — | — | — | 0.0036 | 0.99 | Invent. |
| 38 | 0.07 | 0.24 | 1.91 | 0.020 | 0.011 | 0.0015 | 0.59 | 0.0042 | 0.0021 | — | 0.0013 | 0.12 | — | — | — | 0.08 | — | 0.0005 | — | 1.13 | Invent. |
| 39 | 0.07 | 0.18 | 1.66 | 0.026 | 0.013 | 0.0012 | 0.69 | 0.0047 | 0.0010 | — | 0.0027 | 0.41 | 0.0096 | 0.12 | — | — | 0.12 | 0.0018 | — | 1.15 | Invent. |
| 40 | 0.04 | 0.15 | 1.83 | 0.021 | 0.013 | 0.0008 | 0.53 | 0.0035 | 0.0025 | — | 0.0011 | 0.34 | 0.0113 | 0.19 | 0.025 | 0.05 | — | 0.0015 | 0.0035 | 0.97 | Invent. |
| 41 | 0.06 | 0.31 | 2.95 | 0.019 | 0.009 | 0.0005 | 0.77 | 0.0054 | 0.0024 | — | 0.0017 | 0.25 | 0.0087 | 0.26 | — | 0.06 | — | 0.0014 | 0.0034 | 2.27 | Invent. |
| 42 | 0.05 | 0.24 | 2.39 | 0.020 | 0.016 | 0.0007 | 0.44 | 0.0060 | 0.0027 | 0.0018 | 0.0012 | 0.18 | — | — | — | — | 0.12 | 0.0007 | 0.0022 | 1.05 | Invent. |
| 43 | 0.06 | 0.20 | 1.74 | 0.024 | 0.014 | 0.0005 | 0.72 | 0.0033 | 0.0011 | — | 0.0018 | 0.28 | — | — | — | 0.08 | 0.30 | — | 0.0014 | 1.25 | Invent. |
| 44 | 0.03 | 0.32 | 1.92 | 0.023 | 0.015 | 0.0007 | 0.43 | 0.0042 | 0.0025 | — | 0.0016 | 0.25 | — | — | 0.023 | — | 0.30 | 0.0019 | — | 0.83 | Invent. |

TABLE 1-continued

| Steel No. | Chemical composition of steel (mass %, bal.: Fe and impurities; among the elements indicated below, P, S, and O are impirities) | | | | | | | | | | | | | | | | | | | | |
|---|---|---|---|---|---|---|---|---|---|---|---|---|---|---|---|---|---|---|---|---|---|
| | C | Si | Mn | sol. Al | P | S | Mo | N | Ca | REM | O | Cr | Ti | Ni | Nb | V | Cu | B | Mg | [Mn] × [Mo] | Remark |
| 45 | 0.04 | 0.29 | 2.86 | 0.023 | 0.017 | 0.0010 | 0.60 | 0.0056 | 0.0015 | 0.0016 | 0.0016 | 0.30 | 0.0065 | 0.31 | 0.013 | 0.10 | — | — | 0.0011 | 1.72 | Invent. |
| 46 | 0.06 | 0.20 | 1.65 | 0.023 | 0.006 | 0.0009 | 0.64 | 0.0054 | 0.0008 | — | 0.0022 | 0.37 | 0.0088 | 0.08 | 0.022 | — | 0.29 | — | — | 1.06 | Invent. |
| 47 | 0.04 | 0.15 | 2.83 | 0.023 | 0.007 | 0.0012 | 0.73 | 0.0046 | 0.0013 | — | 0.0017 | 0.21 | 0.0053 | 0.36 | 0.012 | 0.06 | — | — | — | 2.07 | Invent. |
| 48 | 0.04 | 0.19 | 2.71 | 0.023 | 0.013 | 0.0005 | 0.79 | 0.0037 | 0.0024 | — | 0.0021 | 0.10 | 0.0092 | — | 0.017 | 0.08 | 0.14 | — | — | 2.14 | Invent. |
| 49 | 0.04 | 0.11 | 3.00 | 0.026 | 0.008 | 0.0009 | 0.71 | 0.0057 | 0.0028 | — | 0.0029 | 0.33 | 0.0096 | 0.20 | 0.015 | — | — | — | — | 2.13 | Invent. |
| 50 | 0.06 | 0.15 | 2.08 | 0.030 | 0.013 | 0.0015 | 0.57 | 0.0037 | 0.0027 | — | 0.0010 | 0.37 | 0.0079 | 0.31 | 0.015 | — | — | 0.0016 | — | 1.19 | Invent. |
| 51 | 0.04 | 0.22 | 1.91 | 0.017 | 0.004 | 0.0011 | 0.46 | 0.0058 | 0.0023 | — | 0.0021 | 0.14 | — | — | — | — | — | 0.0006 | — | 0.88 | Invent. |
| 52 | 0.06 | 0.35 | 1.87 | 0.018 | 0.005 | 0.0016 | 0.59 | 0.0050 | 0.0023 | — | 0.0020 | 0.43 | — | — | — | 0.07 | 0.13 | 0.0013 | — | 1.10 | Invent. |
| 53 | 0.07 | 0.39 | 1.77 | 0.020 | 0.014 | 0.0012 | 0.76 | 0.0037 | 0.0015 | — | 0.0013 | 0.26 | — | — | — | 0.09 | — | — | — | 1.35 | Invent. |
| 54 | 0.04 | 0.36 | 2.38 | 0.016 | 0.011 | 0.0007 | 0.49 | 0.0047 | 0.0026 | — | 0.0017 | 0.42 | 0.0111 | — | — | — | 0.28 | — | — | 1.17 | Invent. |
| 55 | 0.04 | 0.35 | 1.79 | 0.017 | 0.005 | 0.0013 | 0.61 | 0.0046 | 0.0010 | — | 0.0012 | 0.30 | — | — | 0.008 | — | — | 0.0013 | — | 1.09 | Invent. |
| 56 | 0.07 | 0.22 | 2.03 | 0.030 | 0.014 | 0.0013 | 0.75 | 0.0054 | 0.0022 | — | 0.0026 | 0.36 | 0.0108 | 0.10 | 0.016 | 0.13 | 0.23 | — | 0.0007 | 1.52 | Invent. |
| 57 | 0.06 | 0.29 | 2.71 | 0.022 | 0.007 | 0.0016 | 0.76 | 0.0052 | 0.0027 | — | 0.0021 | 0.44 | 0.0133 | — | — | — | — | — | 0.0013 | 2.06 | Invent. |
| 58 | 0.07 | 0.32 | 1.84 | 0.017 | 0.011 | 0.0006 | 0.70 | 0.0058 | 0.0021 | — | 0.0029 | 0.49 | 0.0110 | 0.09 | 0.020 | 0.09 | 0.11 | 0.0008 | 0.0013 | 1.29 | Invent. |
| 59 | 0.04 | 0.13 | 2.63 | 0.023 | 0.018 | 0.0012 | 0.60 | 0.0038 | 0.0008 | — | 0.0014 | 0.46 | — | — | — | — | 0.32 | 0.0006 | — | 1.58 | Invent. |
| 60 | 0.04 | 0.20 | 1.63 | 0.017 | 0.012 | 0.0013 | 0.73 | 0.0041 | 0.0015 | — | 0.0028 | 0.13 | 0.0129 | — | 0.019 | 0.11 | — | — | — | 1.19 | Invent. |
| 61 | 0.04 | 0.38 | 2.33 | 0.015 | 0.008 | 0.0011 | 0.61 | 0.0057 | 0.0015 | — | 0.0012 | 0.35 | 0.0133 | — | — | 0.12 | — | 0.0008 | — | 1.42 | Invent. |
| 62 | 0.07 | 0.29 | 2.71 | 0.029 | 0.018 | 0.0014 | 0.56 | 0.0040 | 0.0017 | 0.0015 | 0.0025 | 0.13 | — | — | — | — | 0.29 | — | — | 1.52 | Invent. |
| 63 | 0.05 | 0.22 | 1.82 | 0.024 | 0.007 | 0.0004 | 0.45 | 0.0038 | 0.0013 | — | 0.0017 | 0.36 | — | — | 0.025 | — | 0.12 | — | — | 0.82 | Invent. |
| 64 | 0.06 | 0.16 | 1.69 | 0.026 | 0.011 | 0.0015 | 0.64 | 0.0036 | 0.0027 | — | 0.0013 | 0.47 | 0.0069 | — | 0.018 | — | — | 0.0017 | 0.0035 | 1.08 | Invent. |
| 65 | 0.04 | 0.29 | 2.69 | 0.028 | 0.014 | 0.0006 | 0.80 | 0.0059 | 0.0017 | — | 0.0025 | 0.34 | — | — | 0.014 | — | — | 0.0012 | 0.0029 | 2.15 | Invent. |
| 66 | 0.03 | 0.18 | 1.67 | 0.026 | 0.015 | 0.0013 | 0.71 | 0.0030 | 0.0013 | — | 0.0013 | 0.23 | — | — | 0.010 | 0.11 | 0.36 | — | 0.0021 | 1.19 | Invent. |
| 67 | 0.03 | 0.28 | 1.96 | 0.025 | 0.010 | 0.0013 | 0.63 | 0.0039 | 0.0012 | — | 0.0023 | 0.32 | — | — | — | — | — | — | — | 1.23 | Invent. |
| 68 | 0.03 | 0.18 | 1.98 | 0.021 | 0.011 | 0.0012 | 0.57 | 0.0046 | 0.0027 | — | 0.0029 | 0.50 | 0.0086 | — | — | — | — | — | — | 1.13 | Invent. |
| 69 | 0.03 | 0.35 | 2.98 | 0.020 | 0.016 | 0.0011 | 0.72 | 0.0054 | 0.0017 | — | 0.0018 | 0.37 | — | — | — | 0.11 | 0.22 | 0.0019 | 0.0007 | 2.15 | Invent. |
| 70 | 0.03 | 0.29 | 2.19 | 0.030 | 0.007 | 0.0009 | 0.71 | 0.0053 | 0.0016 | — | 0.0029 | 0.15 | — | — | 0.024 | 0.12 | 0.19 | — | — | 1.55 | Invent. |
| 71 | 0.05 | 0.31 | 2.86 | 0.017 | 0.007 | 0.0007 | 0.45 | 0.0050 | 0.0027 | — | 0.0018 | 0.26 | 0.0124 | 0.23 | 0.022 | 0.07 | 0.39 | — | — | 1.29 | Invent. |
| 72 | 0.04 | 0.24 | 1.79 | 0.016 | 0.008 | 0.0016 | 0.78 | 0.0038 | 0.0015 | — | 0.0019 | 0.39 | 0.0134 | — | — | — | 0.11 | 0.0006 | 0.0020 | 1.40 | Invent. |
| 73 | 0.04 | 0.20 | 1.63 | 0.020 | 0.013 | 0.0006 | 0.54 | 0.0032 | 0.0012 | — | 0.0016 | 0.49 | 0.0066 | 0.11 | — | 0.07 | — | — | 0.0012 | 0.88 | Invent. |
| 74 | 0.04 | 0.31 | 1.78 | 0.022 | 0.014 | 0.0007 | 0.46 | 0.0053 | 0.0023 | 0.0027 | 0.0023 | 0.10 | 0.0131 | 0.21 | 0.024 | 0.10 | — | 0.0013 | — | 0.82 | Invent. |
| 75 | 0.04 | 0.33 | 1.65 | 0.023 | 0.018 | 0.0004 | 0.69 | 0.0044 | 0.0026 | — | 0.0026 | 0.26 | 0.0084 | 0.27 | — | 0.13 | 0.24 | 0.0006 | — | 1.14 | Invent. |
| 76 | 0.06 | 0.33 | 1.71 | 0.019 | 0.012 | 0.0014 | 0.64 | 0.0040 | 0.0026 | — | 0.0027 | 0.16 | — | — | — | — | — | — | 0.0018 | 1.09 | Invent. |
| 77 | 0.04 | 0.31 | 2.93 | 0.025 | 0.015 | 0.0015 | 0.69 | 0.0031 | 0.0024 | — | 0.0025 | 0.23 | 0.0076 | — | — | 0.12 | 0.22 | 0.0015 | 0.0008 | 2.02 | Invent. |
| 78 | 0.04 | 0.22 | 2.80 | 0.017 | 0.008 | 0.0005 | 0.44 | 0.0055 | 0.0022 | — | 0.0019 | 0.10 | 0.0098 | — | 0.026 | 0.12 | 0.24 | 0.0014 | — | 1.23 | Invent. |
| 79 | 0.06 | 0.10 | 2.19 | 0.017 | 0.008 | 0.0007 | 0.55 | 0.0053 | 0.0012 | — | 0.0026 | 0.40 | 0.0072 | — | — | — | 0.36 | 0.0006 | — | 1.20 | Invent. |
| 80 | 0.08 | 0.25 | 2.42 | 0.015 | 0.005 | 0.0012 | 0.47 | 0.0049 | 0.0022 | — | 0.0015 | 0.43 | 0.0101 | 0.26 | — | — | — | 0.0014 | — | 1.14 | Invent. |
| 81 | 0.06 | 0.27 | 2.50 | 0.021 | 0.004 | 0.0013 | 0.77 | 0.0038 | 0.0018 | — | 0.0019 | 0.32 | — | — | 0.008 | 0.12 | 0.13 | 0.0011 | 0.0014 | 1.93 | Invent. |
| 82 | 0.05 | 0.16 | 2.64 | 0.022 | 0.006 | 0.0008 | 0.64 | 0.0053 | 0.0021 | — | 0.0015 | 0.16 | 0.0082 | — | — | 0.06 | 0.12 | — | 0.0037 | 1.69 | Invent. |
| 83 | 0.04 | 0.18 | 1.71 | 0.026 | 0.011 | 0.0013 | 0.58 | 0.0037 | 0.0023 | — | 0.0015 | 0.41 | 0.0084 | — | 0.008 | — | 0.37 | 0.0008 | 0.0036 | 0.99 | Invent. |
| 84 | 0.07 | 0.23 | 1.92 | 0.028 | 0.007 | 0.0009 | 0.75 | 0.0059 | 0.0012 | — | 0.0011 | 0.16 | 0.0101 | — | — | — | — | 0.0018 | — | 1.44 | Invent. |
| 85 | 0.05 | 0.25 | 2.60 | 0.029 | 0.013 | 0.0011 | 0.72 | 0.0037 | 0.0012 | — | 0.0027 | 0.38 | 0.0143 | — | 0.023 | 0.12 | — | 0.0019 | — | 1.87 | Invent. |
| 86 | 0.04 | 0.20 | 1.93 | 0.023 | 0.006 | 0.0013 | 0.63 | 0.0044 | 0.0025 | 0.0022 | 0.0025 | 0.16 | 0.0071 | 0.17 | 0.026 | — | — | — | 0.0035 | 1.22 | Invent. |
| 87 | 0.06 | 0.12 | 1.77 | 0.019 | 0.010 | 0.0012 | 0.58 | 0.0036 | 0.0017 | — | 0.0016 | 0.15 | 0.0128 | 0.33 | — | 0.12 | — | 0.0012 | — | 1.03 | Invent. |
| 88 | 0.05 | 0.10 | 2.53 | 0.026 | 0.017 | 0.0009 | 0.64 | 0.0052 | 0.0011 | — | 0.0019 | 0.37 | 0.0075 | — | 0.015 | 0.06 | 0.39 | — | 0.0029 | 1.62 | Invent. |
| 89 | 0.07 | 0.13 | 2.08 | 0.020 | 0.018 | 0.0012 | 0.58 | 0.0059 | 0.0025 | — | 0.0020 | 0.48 | — | — | 0.010 | — | — | — | — | 1.21 | Invent. |
| 90 | 0.07 | 0.30 | 2.65 | 0.020 | 0.006 | 0.0009 | 0.77 | 0.0036 | 0.0025 | — | 0.0016 | 0.41 | — | — | 0.017 | — | 0.24 | 0.0015 | 0.0015 | 2.04 | Invent. |

TABLE 1-continued

| Steel No. | Chemical composition of steel (mass %, bal.: Fe and impurities; among the elements indicated below, P, S, and O are impirities) | | | | | | | | | | | | | | | | | | | | |
|---|---|---|---|---|---|---|---|---|---|---|---|---|---|---|---|---|---|---|---|---|---|
| | C | Si | Mn | sol. Al | P | S | Mo | N | Ca | REM | O | Cr | Ti | Ni | Nb | V | Cu | B | Mg | [Mn] × [Mo] | Remark |
| 91 | 0.06 | 0.23 | 2.94 | 0.024 | 0.005 | 0.0014 | 0.79 | 0.0031 | 0.0018 | — | 0.0023 | 0.44 | 0.0067 | 0.15 | — | — | — | 0.0014 | 0.0023 | 2.32 | Invent. |
| 92 | 0.05 | 0.28 | 2.02 | 0.022 | 0.009 | 0.0009 | 0.76 | 0.0044 | 0.0013 | — | 0.0014 | 0.28 | 0.0144 | 0.35 | — | 0.08 | — | — | — | 1.54 | Invent. |
| 93 | 0.03 | 0.35 | 2.93 | 0.029 | 0.012 | 0.0016 | 0.64 | 0.0041 | 0.0024 | — | 0.0019 | 0.32 | — | — | — | — | — | 0.0008 | 0.0039 | 1.88 | Invent. |
| 94 | 0.05 | 0.12 | 2.16 | 0.022 | 0.015 | 0.0010 | 0.59 | 0.0051 | 0.0023 | — | 0.0012 | 0.30 | 0.0075 | — | 0.013 | — | 0.38 | 0.0012 | — | 1.27 | Invent. |
| 95 | 0.07 | 0.30 | 2.85 | 0.028 | 0.015 | 0.0009 | 0.53 | 0.0048 | 0.0021 | — | 0.0020 | 0.15 | — | — | — | — | 0.28 | — | 0.0016 | 1.51 | Invent. |
| 96 | 0.06 | 0.32 | 2.14 | 0.020 | 0.016 | 0.0008 | 0.68 | 0.0057 | 0.0009 | — | 0.0026 | 0.36 | 0.0095 | — | 0.013 | 0.07 | — | — | 0.0031 | 1.46 | Invent. |
| 97 | 0.03 | 0.38 | 1.85 | 0.019 | 0.014 | 0.0012 | 0.68 | 0.0056 | 0.0028 | — | 0.0015 | 0.20 | 0.0080 | 0.14 | — | — | 0.12 | 0.0010 | 0.0006 | 1.26 | Invent. |
| 98 | 0.05 | 0.36 | 2.13 | 0.023 | 0.013 | 0.0008 | 0.68 | 0.0045 | 0.0010 | — | 0.0022 | 0.43 | 0.0094 | 0.07 | 0.024 | — | 0.31 | 0.0006 | 0.0033 | 1.45 | Invent. |
| 99 | 0.12 | 0.14 | 2.51 | 0.022 | 0.008 | 0.0010 | 0.51 | 0.0040 | 0.0016 | — | 0.0023 | 0.33 | 0.0080 | 0.28 | — | — | — | — | — | 1.28 | Compar. |
| 100 | 0.04 | 0.62 | 2.01 | 0.016 | 0.011 | 0.0005 | 0.56 | 0.0047 | 0.0026 | — | 0.0015 | 0.21 | 0.0089 | — | — | — | — | — | — | 1.13 | Compar. |
| 101 | 0.06 | 0.31 | 1.01 | 0.024 | 0.006 | 0.0014 | 0.81 | 0.0056 | 0.0011 | — | 0.0013 | 0.26 | 0.0081 | — | — | — | — | — | — | 0.82 | Compar. |
| 102 | 0.05 | 0.14 | 2.24 | 0.122 | 0.011 | 0.0014 | 0.72 | 0.0050 | 0.0009 | 0.0027 | 0.0013 | 0.49 | 0.0088 | — | — | — | — | — | — | 1.61 | Compar. |
| 103 | 0.05 | 0.35 | 2.13 | 0.028 | 0.066 | 0.0008 | 0.44 | 0.0041 | 0.0016 | — | 0.0028 | 0.38 | 0.0091 | — | — | — | — | — | — | 0.94 | Compar. |
| 104 | 0.04 | 0.16 | 1.90 | 0.023 | 0.010 | 0.0072 | 0.68 | 0.0047 | 0.0026 | — | 0.0025 | 0.32 | 0.0075 | 0.09 | — | — | — | — | — | 1.29 | Compar. |
| 105 | 0.07 | 0.29 | 2.47 | 0.026 | 0.009 | 0.0007 | 0.37 | 0.0037 | 0.0021 | — | 0.0024 | 0.15 | 0.0076 | 0.19 | — | — | — | — | — | 0.91 | Compar. |
| 106 | 0.05 | 0.31 | 1.79 | 0.021 | 0.016 | 0.0016 | 0.77 | 0.0258 | 0.0028 | — | 0.0019 | 0.25 | 0.0085 | — | — | — | — | — | — | 1.38 | Compar. |
| 107 | 0.03 | 0.18 | 2.39 | 0.019 | 0.011 | 0.0013 | 0.77 | 0.0035 | — | — | 0.0022 | 0.34 | 0.0083 | — | — | — | — | — | — | 1.84 | Compar. |
| 108 | 0.05 | 0.18 | 2.98 | 0.016 | 0.015 | 0.0012 | 0.68 | 0.0045 | 0.0010 | — | 0.0081 | 0.49 | 0.0084 | — | — | — | — | — | — | 2.03 | Compar. |
| 109 | 0.07 | 0.42 | 1.57 | 0.025 | 0.022 | 0.0014 | 0.42 | 0.0048 | 0.0015 | — | 0.0018 | 0.53 | 0.0072 | 0.75 | — | — | 0.64 | — | — | 0.66 | Compar. |
| 110 | 0.07 | 0.34 | 1.53 | 0.022 | 0.023 | 0.0014 | 0.42 | 0.0052 | 0.0017 | — | 0.0021 | 0.39 | 0.0083 | 0.48 | — | — | 0.32 | — | — | 0.64 | Compar. |
| 111 | 0.03 | 0.25 | 1.60 | 0.026 | 0.020 | 0.0015 | 0.41 | 0.0049 | 0.0013 | — | 0.0015 | 0.30 | 0.0087 | 0.24 | — | — | — | — | — | 0.66 | Compar. |

TABLE 2

| Steel No. | Finish rolling T. (° C.) | Finish cooling T. (° C.) | Reheating T. (° C.) | Tempering T. (° C.) | Yield Strength (MPa) | Charpy FATT* (° C.) | Resistance to SSC | Remarks |
|---|---|---|---|---|---|---|---|---|
| 1 | 1050 | 900 | 920 | 630 | 642 | −65 | ○○○ | Invent. |
| 2 | 950 | 900 | 920 | 630 | 615 | −62 | ○○○ | Invent. |
| 3 | 950 | — | — | 630 | 686 | −76 | ○○○ | Invent. |
| 4 | 1050 | 900 | 920 | 610 | 732 | −66 | ○○○ | Invent. |
| 5 | 1000 | 950 | 980 | 630 | 662 | −56 | ○○○ | Invent. |
| 6 | 1050 | 900 | 920 | 630 | 694 | −61 | ○○○ | Invent. |
| 7 | 950 | 900 | 920 | 630 | 633 | −64 | ○○○ | Invent. |
| 8 | 1050 | R.T. | 920 | 630 | 615 | −76 | ○○○ | Invent. |
| 9 | 1000 | 950 | 980 | 630 | 676 | −60 | ○○○ | Invent. |
| 10 | 1050 | 900 | 920 | 630 | 694 | −62 | ○○○ | Invent. |
| 11 | 1050 | — | — | 610 | 752 | −65 | ○○○ | Invent. |
| 12 | 1000 | — | — | 630 | 616 | −73 | ○○○ | Invent. |
| 13 | 950 | 900 | 920 | 630 | 644 | −67 | ○○○ | Invent. |
| 14 | 1050 | 900 | 920 | 630 | 736 | −67 | ○○○ | Invent. |
| 15 | 950 | 900 | 920 | 630 | 691 | −70 | ○○○ | Invent. |
| 16 | 1000 | R.T. | 920 | 610 | 730 | −67 | ○○○ | Invent. |
| 17 | 950 | 900 | 920 | 630 | 611 | −63 | ○○○ | Invent. |
| 18 | 950 | 900 | 920 | 630 | 691 | −63 | ○○○ | Invent. |
| 19 | 1000 | 950 | 980 | 630 | 682 | −64 | ○○○ | Invent. |
| 20 | 1000 | — | — | 630 | 610 | −73 | ○○○ | Invent. |
| 21 | 1050 | 900 | 920 | 630 | 764 | −74 | ○○○ | Invent. |
| 22 | 1050 | 900 | 920 | 630 | 600 | −70 | ○○○ | Invent. |
| 23 | 950 | 900 | 920 | 630 | 700 | −64 | ○○○ | Invent. |
| 24 | 950 | R.T. | 920 | 630 | 610 | −64 | ○○○ | Invent. |
| 25 | 1000 | 950 | 980 | 630 | 631 | −61 | ○○○ | Invent. |
| 26 | 1050 | — | — | 630 | 685 | −69 | ○○○ | Invent. |
| 27 | 1050 | 900 | 920 | 640 | 584 | −64 | ○○○ | Invent. |
| 28 | 950 | 900 | 920 | 640 | 596 | −75 | ○○○ | Invent. |
| 29 | 1050 | 900 | 920 | 640 | 565 | −75 | ○○○ | Invent. |
| 30 | 1050 | 900 | 920 | 630 | 628 | −61 | ○○○ | Invent. |
| 31 | 1000 | 950 | 980 | 610 | 710 | −54 | ○○○ | Invent. |
| 32 | 1000 | R.T. | 920 | 610 | 713 | −65 | ○○○ | Invent. |
| 33 | 1050 | 900 | 920 | 610 | 715 | −65 | ○○○ | Invent. |
| 34 | 1050 | 900 | 920 | 630 | 756 | −57 | ○○○ | Invent. |
| 35 | 950 | — | — | 630 | 666 | −52 | ○○○ | Invent. |
| 36 | 1000 | — | — | 630 | 719 | −63 | ○○○ | Invent. |
| 37 | 950 | 900 | 920 | 630 | 615 | −65 | ○○○ | Invent. |
| 38 | 1000 | 950 | 980 | 630 | 609 | −67 | ○○○ | Invent. |
| 39 | 1050 | R.T. | 920 | 630 | 628 | −66 | ○○○ | Invent. |
| 40 | 950 | 900 | 920 | 630 | 608 | −58 | ○○○ | Invent. |
| 41 | 950 | 900 | 920 | 630 | 761 | −78 | ○○○ | Invent. |
| 42 | 950 | 900 | 920 | 630 | 637 | −54 | ○○○ | Invent. |
| 43 | 1050 | — | — | 630 | 612 | −78 | ○○○ | Invent. |
| 44 | 1000 | 950 | 980 | 630 | 600 | −61 | ○○○ | Invent. |
| 45 | 1050 | 900 | 920 | 610 | 762 | −58 | ○○○ | Invent. |
| 46 | 1000 | R.T. | 920 | 630 | 638 | −65 | ○○○ | Invent. |
| 47 | 950 | R.T. | 920 | 600 | 749 | −67 | ○○○ | Invent. |
| 48 | 1000 | 950 | 980 | 630 | 719 | −69 | ○○○ | Invent. |
| 49 | 950 | 900 | 920 | 630 | 757 | −69 | ○○○ | Invent. |
| 50 | 1050 | 900 | 920 | 630 | 630 | −64 | ○○○ | Invent. |
| 51 | 1050 | 900 | 920 | 640 | 558 | −69 | ○○○ | Invent. |
| 52 | 1050 | 900 | 920 | 630 | 647 | −54 | ○○○ | Invent. |
| 53 | 1000 | — | — | 630 | 610 | −69 | ○○○ | Invent. |
| 54 | 1050 | — | — | 630 | 678 | −53 | ○○○ | Invent. |
| 55 | 1050 | — | — | 630 | 565 | −78 | ○○○ | Invent. |
| 56 | 950 | 900 | 920 | 630 | 721 | −54 | ○○○ | Invent. |
| 57 | 1000 | 950 | 980 | 630 | 736 | −77 | ○○○ | Invent. |
| 58 | 950 | 900 | 920 | 630 | 673 | −66 | ○○○ | Invent. |
| 59 | 1050 | 900 | 920 | 630 | 717 | −57 | ○○○ | Invent. |
| 60 | 1050 | 900 | 920 | 630 | 596 | −65 | ○○○ | Invent. |
| 61 | 950 | 900 | 920 | 630 | 659 | −61 | ○○○ | Invent. |
| 62 | 950 | 900 | 920 | 630 | 712 | −68 | ○○○ | Invent. |
| 63 | 1050 | — | — | 630 | 587 | −68 | ○○○ | Invent. |
| 64 | 950 | 900 | 920 | 630 | 611 | −75 | ○○○ | Invent. |
| 65 | 1000 | R.T. | 920 | 620 | 721 | −75 | ○○○ | Invent. |
| 66 | 1000 | 950 | 980 | 630 | 607 | −77 | ○○○ | Invent. |
| 67 | 950 | 900 | 920 | 630 | 607 | −67 | ○○○ | Invent. |
| 68 | 1050 | — | — | 630 | 620 | −62 | ○○○ | Invent. |
| 69 | 1050 | 900 | 920 | 610 | 788 | −69 | ○○○ | Invent. |
| 70 | 1000 | 950 | 980 | 630 | 640 | −74 | ○○○ | Invent. |
| 71 | 950 | 900 | 920 | 630 | 748 | −51 | ○○○ | Invent. |
| 72 | 1000 | 950 | 980 | 630 | 627 | −70 | ○○○ | Invent. |
| 73 | 950 | 900 | 920 | 630 | 617 | −52 | ○○○ | Invent. |
| 74 | 1000 | R.T. | 920 | 640 | 561 | −76 | ○○○ | Invent. |
| 75 | 950 | 900 | 920 | 630 | 637 | −64 | ○○○ | Invent. |
| 76 | 950 | 900 | 920 | 630 | 591 | −66 | ○○○ | Invent. |

TABLE 2-continued

| Steel No. | Finish rolling T. (° C.) | Finish cooling T. (° C.) | Reheating T. (° C.) | Tempering T. (° C.) | Yield Strength (MPa) | Charpy FATT* (° C.) | Resistance to SSC | Remarks |
|---|---|---|---|---|---|---|---|---|
| 77 | 1050 | 900 | 920 | 610 | 741 | −66 | ○○○ | Invent. |
| 78 | 1050 | 900 | 920 | 630 | 684 | −49 | ○○○ | Invent. |
| 79 | 1000 | 950 | 980 | 630 | 672 | −59 | ○○○ | Invent. |
| 80 | 950 | — | — | 630 | 712 | −55 | ○○○ | Invent. |
| 81 | 950 | 900 | 920 | 630 | 700 | −66 | ○○○ | Invent. |
| 82 | 950 | 900 | 920 | 630 | 708 | −67 | ○○○ | Invent. |
| 83 | 1050 | 900 | 920 | 630 | 623 | −65 | ○○○ | Invent. |
| 84 | 1050 | 900 | 920 | 630 | 608 | −76 | ○○○ | Invent. |
| 85 | 1000 | 950 | 980 | 600 | 744 | −72 | ○○○ | Invent. |
| 86 | 950 | 900 | 920 | 630 | 611 | −78 | ○○○ | Invent. |
| 87 | 950 | R.T. | 920 | 630 | 624 | −67 | ○○○ | Invent. |
| 88 | 1000 | — | — | 630 | 723 | −59 | ○○○ | Invent. |
| 89 | 1000 | 950 | 980 | 630 | 636 | −62 | ○○○ | Invent. |
| 90 | 1050 | 900 | 920 | 600 | 758 | −66 | ○○○ | Invent. |
| 91 | 1000 | 950 | 980 | 600 | 769 | −69 | ○○○ | Invent. |
| 92 | 1000 | 950 | 980 | 630 | 669 | −77 | ○○○ | Invent. |
| 93 | 950 | 900 | 920 | 630 | 697 | −69 | ○○○ | Invent. |
| 94 | 1050 | — | — | 630 | 636 | −70 | ○○○ | Invent. |
| 95 | 950 | 900 | 920 | 630 | 695 | −54 | ○○○ | Invent. |
| 96 | 1050 | R.T. | 920 | 630 | 693 | −58 | ○○○ | Invent. |
| 97 | 1000 | 950 | 980 | 640 | 579 | −76 | ○○○ | Invent. |
| 98 | 1050 | 900 | 920 | 630 | 673 | −68 | ○○○ | Invent. |
| 99 | 1000 | 950 | 980 | 630 | 707 | 12 | ○○○ | Compar. |
| 100 | 1000 | 950 | 980 | 630 | 588 | −30 | ○○○ | Compar. |
| 101 | 1050 | 900 | 920 | 630 | 495 | −45 | ○○○ | Compar. |
| 102 | 950 | 900 | 920 | 630 | 671 | −21 | ○○○ | Compar. |
| 103 | 1050 | 900 | 920 | 630 | 612 | −18 | XXX | Compar. |
| 104 | 1050 | 900 | 920 | 630 | 639 | −4 | XXX | Compar. |
| 105 | 950 | 900 | 920 | 590 | 626 | −21 | ○○X | Compar. |
| 106 | 1050 | 900 | 920 | 630 | 599 | −36 | ○○○ | Compar. |
| 107 | 1050 | 900 | 920 | 630 | 678 | 5 | XXX | Compar. |
| 108 | 1050 | 900 | 920 | 630 | 741 | 21 | ○○○ | Compar. |
| 109 | 1050 | 900 | 920 | 630 | 669 | −12 | ○○○ | Compar. |
| 110 | 1050 | 900 | 920 | 630 | 617 | −33 | ○○○ | Compar. |
| 111 | 1050 | 900 | 920 | 600 | 557 | −46 | ○○○ | Compar. |

*FATT = fracture appearance transition temperature

As can be seen from the results for Steel Nos. 1 through 98 in Table 2, the seamless steel pipes according to the present invention have a high strength corresponding to X80 grade (a yield strength of at least 551 MPa) to X100 grade (a yield strength of at least 689 MPa) of API standards as well as improved toughness (a fracture appearance transition temperature of −50° C. or below) and improved corrosion resistance (resistance to SSC indicated by "○○○" in all the steels).

In contrast, Steel Nos. 99-108, which are comparative examples in which the chemical composition was outside the range defined by the present invention have inferior properties with respect to at least one of strength, toughness, and corrosion resistance.

Figure 2:
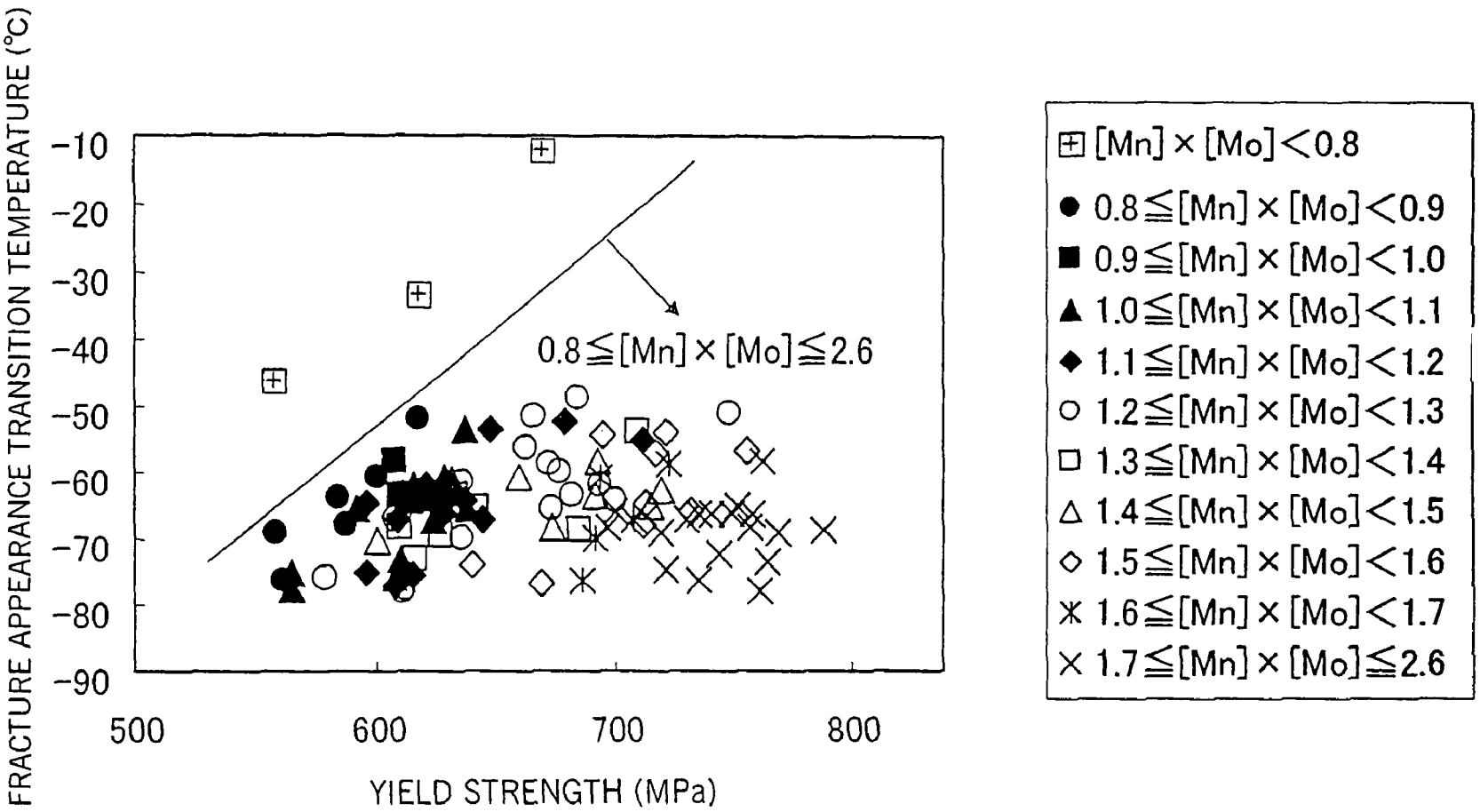
FIG. 2 is a graph showing the relationship between the value of [Mn]×[Mo] and strength and toughness based on the results of an example.

Steel Nos. 109-111 are comparative examples in which the contents of the individual alloying elements were within the range defined by the present invention but the value of [Mn]×[Mo] was smaller than the lower limit, 0.8 defined by the present invention. FIG. 2 is a graph obtained by plotting the results of strength and toughness of these steels along with those of some inventive steels according to the present invention. It should be noted that in the ordinate of this figure which is fracture appearance transition temperature indicative of toughness, the higher in the ordinate (the higher the temperature), the lower the toughness.

In general, the relationship between strength and fracture appearance transition temperature is a linear relationship which slopes upwards to the right, indicating that toughness decreases as strength increases. However, as the value of [Mn]×[Mo] increases, the plots shift to the right in this figure, indicating that strength increases without a decrease in toughness or that strength can be increased with keeping a balance to toughness. Thus, it can be seen from this figure that the balance between strength and toughness is controlled by [Mn]×[Mo]. For Steel Nos. 109 through 111 in which the value of [Mn]×[Mo] was less than 0.8, their toughness is significantly inferior to that of inventive steels having the same strength, indicating that the balance between strength and toughness was not good.

The invention claimed is:

1. A seamless steel pipe for line pipe characterized by having a chemical composition which consisting essentially, in mass percent, of C: 0.02-0.08%, Si: at most 0.5%, Mn: 2.02-3.0%, Al: 0.001-0.10%, Mo: greater than 0.4%-1.2%, N: 0.002-0.015%, at least one of Ca and REM in a total amount of 0.0002-0.007%, Cr: 0-1.0%, Ti: 0-0.05%, Ni: 0-2.0%, Nb: 0-0.04%, V: 0-0.2%, Cu: 0-1.5%, B: 0-0.01%, Mg: 0-0.007%, and a remainder of Fe and impurities, with the impurities having the content of P: at most 0.05%, S: at most 0.005%, and O: at most 0.005%, and the chemical composition satisfying the following inequality:

$$1.1 \leqq [Mn] \times [Mo] \leqq 2.6,$$

wherein [Mn] and [Mo] are the numbers equivalent to the contents of Mn and Mo, respectively, in mass percent.

2. A seamless steel pipe for line pipe as set forth in claim 1 wherein the chemical composition contains one or more elements, in mass percent, selected from Cr: 0.02-1.0%, Ti: 0.003-0.05%, Ni: 0.02-2.0%, Nb: 0.003-0.04%, V: 0.003-0.2%, Cu: 0.02-1.5%, B: 0.0002-0.01%, and Mg: 0.0002-0.007%.

3. A process of manufacturing a seamless steel pipe for line pipe characterized by forming a seamless steel pipe under hot working conditions from a billet having a chemical composition as set forth in claim 1 and subjecting the resulting steel pipe to quenching and tempering.

4. A process as set forth in claim 3 wherein the steel pipe formed under hot working conditions is cooled and then reheated before it is subjected to quenching.

5. A process as set forth in claim 3 wherein the steel pipe formed under hot working conditions is directly subjected to quenching.

6. A process as set forth in claim 3 wherein tempering is performed at a temperature in the range of 550-700° C.

7. A process of manufacturing a seamless steel pipe for line pipe characterized by forming a seamless steel pipe under hot working conditions from a billet having a chemical composition as set forth in claim 2 and subjecting the resulting steel pipe to quenching and tempering.

* * * * *